United States Patent [19]

Tetenborg et al.

[11] Patent Number: 4,736,940

[45] Date of Patent: Apr. 12, 1988

[54] APPARATUS FOR ALIGNING AN OPENING OF A SACK

[75] Inventors: Konrad Tetenborg; Helmut Huwelmann, both of Lengerich, Fed. Rep. of Germany

[73] Assignee: Windmöller & Hölscher, Lengerich, Fed. Rep. of Germany

[21] Appl. No.: 832,659

[22] Filed: Feb. 25, 1986

[30] Foreign Application Priority Data

Feb. 25, 1985 [DE] Fed. Rep. of Germany ..... 3506616
Aug. 2, 1985 [DE] Fed. Rep. of Germany ..... 3527875

[51] Int. Cl.[4] ..... B65H 7/02

[52] U.S. Cl. ..... 271/228; 271/230; 271/237; 271/238; 271/249; 271/252; 271/261; 271/265

[58] Field of Search ..... 271/227, 237, 261, 228, 271/250–252, 258, 259, 265, 264, 249, 253, 151, 226, 229, 230, 234, 236, 254

[56] References Cited

U.S. PATENT DOCUMENTS

| | | | |
|---|---|---|---|
| 2,182,023 | 12/1939 | Harrold | 271/237 |
| 3,603,446 | 9/1971 | Maxey | 271/227 X |
| 4,438,917 | 3/1984 | Janssen et al. | 271/261 X |
| 4,511,242 | 4/1985 | Ashbee et al. | 271/227 X |

FOREIGN PATENT DOCUMENTS

| | | | |
|---|---|---|---|
| 1180378 | 10/1964 | Fed. Rep. of Germany . | |
| 1217773 | 5/1966 | Fed. Rep. of Germany | 271/258 |
| 2144950 | 3/1972 | Fed. Rep. of Germany . | |
| 2804178 | 8/1979 | Fed. Rep. of Germany . | |
| 930247 | 7/1963 | United Kingdom . | |
| 988561 | 4/1965 | United Kingdom | 271/228 |

*Primary Examiner*—Joseph J. Rolla
*Assistant Examiner*—David H. Bollinger
*Attorney, Agent, or Firm*—Fleit, Jacobson, Cohn & Price

[57] ABSTRACT

Apparatus for aligning a sack disposed at the leading end of a series of shingled sacks, which have been unwound from a roll of shingled sacks and which have openings at their leading ends. The sack is aligned by transversely spaced gripping rollers that are operable to align the leading edge of a sack for proper orientation prior to transfer of the sack to a filling apparatus. An intermittently driven conveyor belt conveys the unwound series of shingled sacks as they are unwound from a roll. At least one pressure-applying roller is disposed above the conveyor belt and acts on the leading sack of the series of shingled sacks and cooperates with a backing roller, which is adapted to be driven, and optional pressure-applying elements, which are adapted to be lowered onto the next following sack.

11 Claims, 3 Drawing Sheets

APPARATUS FOR ALIGNING AN OPENING OF A SACK

BACKGROUND OF THE INVENTION

1. Field of the Invention

This invention relates to apparatus for positioning an opening of a sack which is disposed at the leading end of a series of shingled sacks that have been unwound from a roll of shingled sacks. More particularly, the invention relates to apparatus for aligning the leading edge of a sack relative to a longitudinal conveying direction, and also for positioning side edges of the sack relative to a center line that extends in the conveying direction.

2. Description of the Prior Art

Published German Application No. 28 04 178 discloses an apparatus that serves to transfer to a filling device the leading sack of a series of shingled sacks which have been unwound from a roll of such sacks. The known apparatus does not perform an orientation of the sack so each sack that is to be filled is aligned with gripping arms of a sack transfer apparatus for transferring the sack to the filling device.

The individual sacks which are to be separated from a series of shingled sacks can easily slip relative to the other sacks so that a conveyor belt is not sufficient to convey each sack as reliably as is required to a properly aligned position, in which the sack can satisfactorily be taken over by the gripping means of the sack transfer apparatus. Additionally, the sacks can possibly be delivered in a laterally offset position and may differ in width owing to inevitable manufacturing tolerances. The gripping means cannot satisfactorily transfer the sacks unless the sacks are centered, even if they differ in width.

Apparatus for aligning sheets of sections of tubular films are disclosed in published German Applications Nos. 11 80 378 and 21 44 950.

SUMMARY OF THE INVENTION

Briefly stated, in accordance with one aspect of the present invention, apparatus is provided for aligning a sack which is disposed at the leading end of a series of shingled sacks that have openings at their leading ends. The sack is aligned in a predetermined orientation for sequentially transferring the sacks to a filling apparatus. The alignment apparatus includes a frame, and an intermittently driven conveying means supported by the frame for conveying the sacks in a longitudinal conveying direction. At least one pressure-applying roller is disposed above the conveying means and acts on the sacks as they are conveyed along the apparatus. A pair of laterally spaced, rotatable conveyor rollers is positioned downstream of the pressure-applying rollers and each of the conveyor rollers has its axis of rotation extending transversely relative to the longitudinal conveying direction. A pressure applying means is positioned opposite each of the conveyor rollers to urge a sack positioned between the conveyor rollers and the pressure applying means into conveying engagement with the conveyor rollers. First drive means are provided for independently driving each of the conveyor rollers, and first sensing means are provided for sensing a leading edge of a sack and for providing signals to operate the drive means to orient the leading edge of the sack at a desired orientation relative to the longitudinal conveying direction.

In accordance with a further aspect of the present invention, second sensing means are provided for sensing the side edges of the sack, and a transversely movable carriage is provided and is responsive to the output from the second sensing means to carry the sack transversely relative to the longitudinal conveying direction, in order to position it in a desired transverse position.

DESCRIPTION OF THE PREFERRED EMBODIMENT

Figure 1:
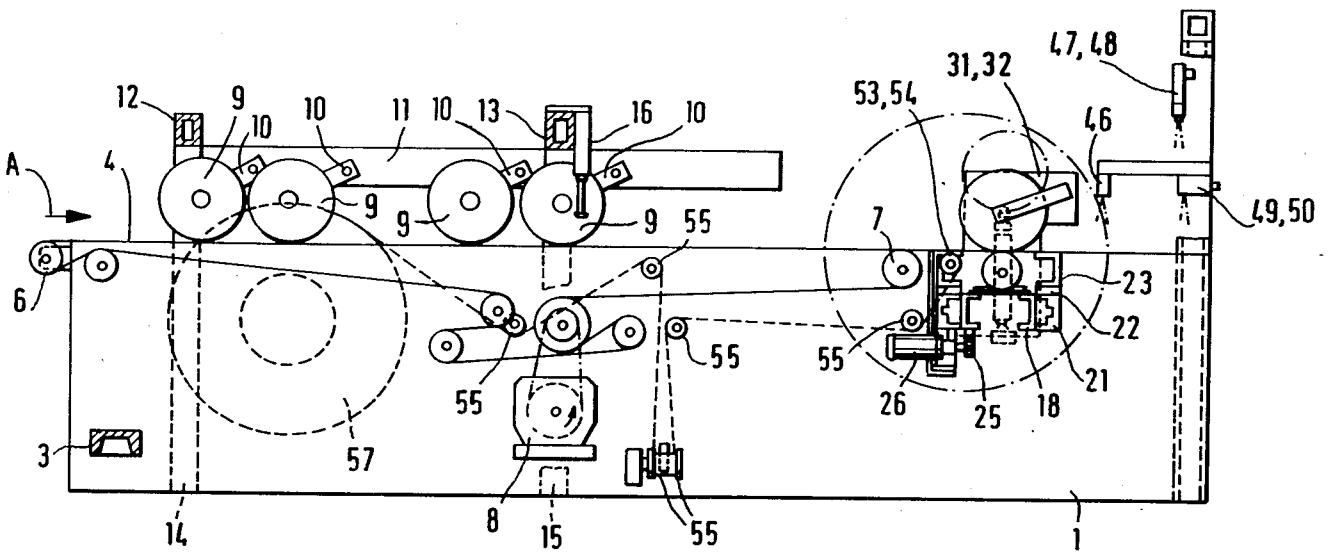
FIG. 1 is a diagrammatic side elevational view showing apparatus for intermittently conveying a series of shingled sacks and for aligning each sack which is to be filled, as that sack is disposed at the leading end of the series of sacks.
Figure 2:
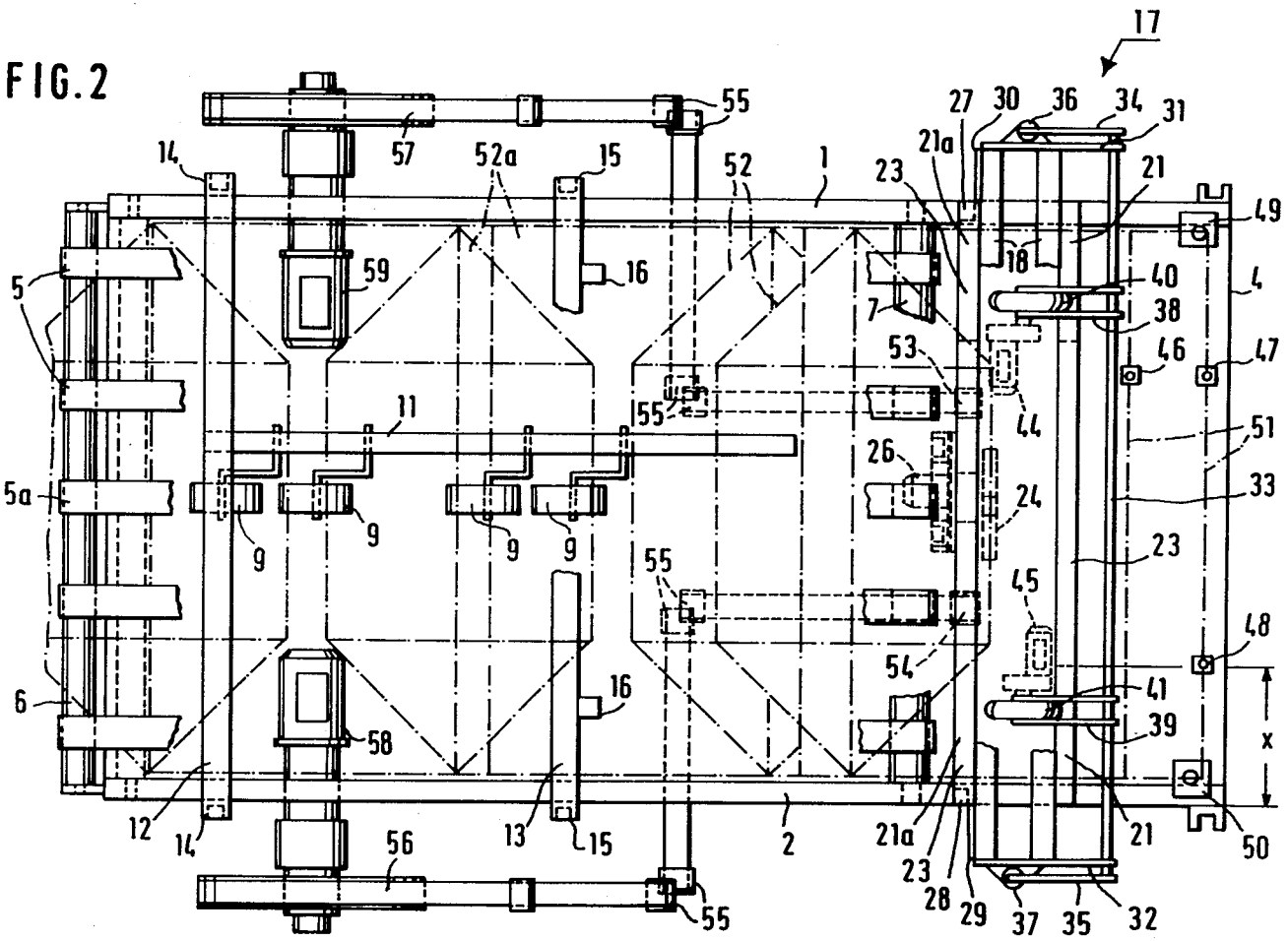
FIG. 2 is a top plan view of the apparatus shown in FIG. 1.

Referring now to the drawings, and particularly to FIGS. 1 and 2 thereof, a machine frame includes laterally spaced side frames 1, 2, which are interconnected by a plurality of crosspieces, only one of which is shown in FIG. 1 as crosspiece 3. The two side frames 1 and 2 support and are covered by a horizontal metal table top 4.

As best seen in FIG. 2, a plurality of parallel conveyor belts 5 extend in a longitudinal direction of the apparatus, designated by arrow A in FIG. 1, and pass around longitudinally spaced reversing pulleys 6 and 7, which are rotatably supported by transverse shafts carried in side frames 1 and 2. Conveyor belts 5 are driven in a known manner by a motor 8 and associated pulleys, and deliver a series of shingled, or partially overlapped sacks that have been unwound from a sack roller (not shown) and delivered to the upstream, or left, side of table 4 as viewed in FIG. 1. Four pivotally mounted, longitudinally spaced pressure-applying rollers 9 are disposed above the conveyor belt **5*a* and contact the tops of the series of shingled stacks as they are received and carried by the conveyor belts 5 and 5*a*. The pressure-applying rollers 9 are carried on rocker levers 10, which are pivoted to a longitudinal beam 11 that is rigidly connected to two cross beams 12 and 13. The cross beams 12 and 13 protrude outwardly beyond the two side frames 1 and 2 and are rigidly welded to respective vertical section members 14 and 15, which, in turn, are secured to the side frames 1 and 2. As is also apparent from FIGS. 1 and 2, the cross beam 13 also carries vertically movable retaining rods 16**.

Figure 3:
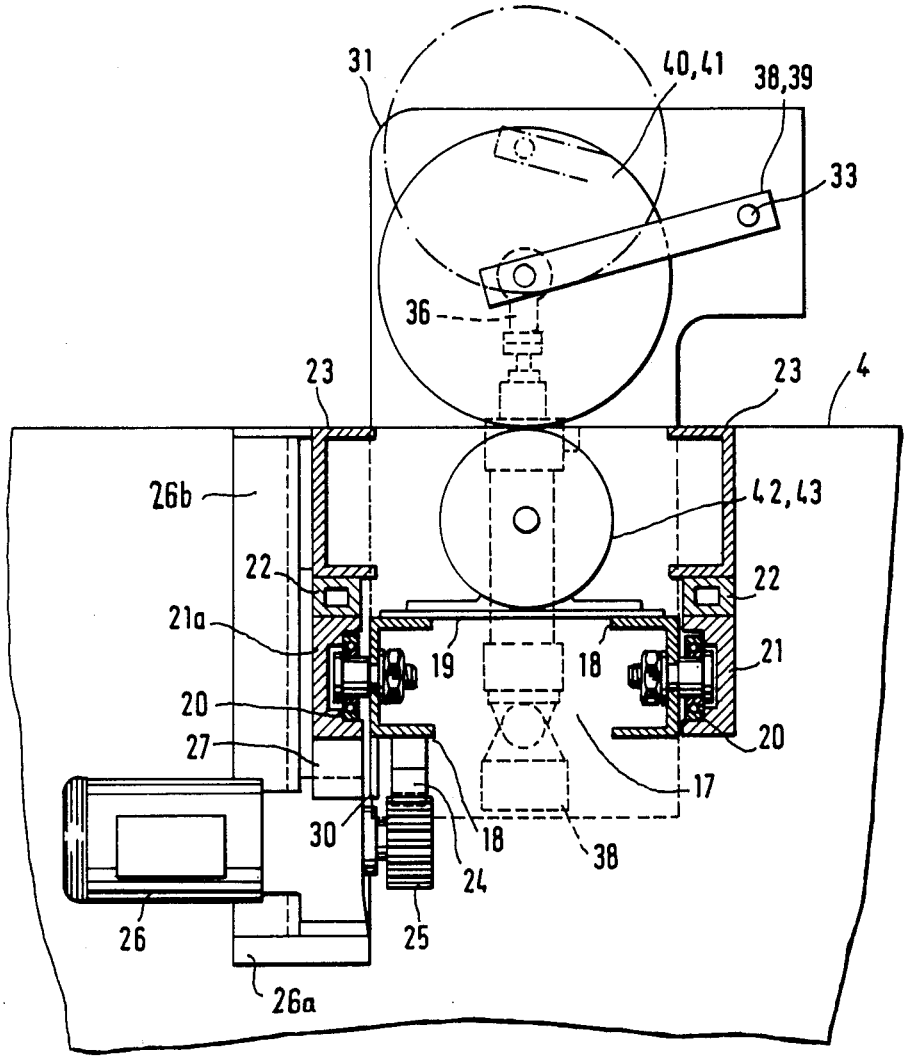
FIG. 3 is an enlarged fragmentary side view showing a portion of the apparatus shown in FIG. 1 and which is surrounded in FIG. 1 by a dashed line circle.

The delivery, or downstream, ends of the conveyor belts 5, **5*a* are followed by devices for aligning the sacks to a predetermined orientation relative to the longitudinal axis of the apparatus. Those devices include a transversely extending carriage 17 defined by two transversely extending section members 18 and a cover plate 19 extending between and connecting the section members. As is apparent from FIG. 2, the carriage 17 also protrudes beyond the two side frames 1 and 2 on both sides. As shown in FIG. 3, the carriage 17 is transversely movable and is carried on wheels 20, which are guided by transverse rails 21 and 21*a*, which are rigidly connected by connectors 22 to channel members 23 that are secured to and extend between side frames 1 and 2**.

As also shown in FIG. 3, the upstream section member 18 carries a downwardly facing, transversely extending rack 24, which is in mesh with a pinion 25 that is connected to the drive shaft of a motor 26, that is rigidly supported on cross frame 26*a*, supported by vertical members 26*b*. Carriage 17 can be moved in both lateral directions between side frames 1 and 2 by means of motor 26, pinion 25, and rack 24 to an extent which is limited by suitable end stops (not shown). The guide rails 21 and 21*a* do not extend throughout the width of the table top, and their length is designated by the distance X in FIG. 2.

As shown in FIGS. 2 and 3, adjacent to the two side frames 1 and 2, switches 27 and 28 are connected to the guide rail 21*a* and are operable by cooperative engagement with switching plates 29 and 30, which are carried by upstream section member 18 at the two transverse outer end portions thereof.

The carriage 17 includes respective outer end plates 31 and 32, which rotatably support a shaft 33 that extends therebetween and is spaced above the table top 4 and protrudes outwardly beyond end plates 31 and 32 at both ends, as best seen in FIG. 2. Levers 34 and 35 extend longitudinally of the machine and have one end secured to the respective outer end portions of shaft 33 outwardly of end plates 31, 32. At their opposite ends, spaced from the shaft 33, levers 34, 35 are pivotally connected to piston rods of pneumatic piston-cylinder units 36, 37, respectively, the latter of which are supported by means of brackets 38 secured to each of the end plates 31 and 32.

As seen in FIGS. 2 and 3, two longitudinally extending holders 38 and 39 are non-rotatably secured to shaft 33 and rotatably carry backing rollers 40 and 41, which overlie and engage with cooperating conveyor rollers 42 and 43, which can be separately driven by motors 44, 45 respectively (see FIG. 2).

Referring once again to FIGS. 1 and 2, when viewed in the longitudinal direction of conveyance represented by arrow A in FIGS. 1, 2, and 3, the carriage 17 is closely followed by a downstream photocell 46 that is disposed above the table top 4. Four additional photocells 47, 48 and 49, 50 are spaced downstream from the photocell 46 and are also disposed transversely from each other across and above the table top 4. The relative vertical positions of the respective photocells are shown in FIG. 1, and the relative horizontal positions thereof are shown in FIG. 2. As will be understood by those skilled in the art, each of the photocells includes a cooperating light source (not shown) positioned below the surface of table top 4 and that projects light beam through suitable openings in top 4 toward the respective photocells associated with the light sources.

In operation, a series of shingled sacks which have been unwound from a roller are deposited on the upstream portion of table top 4 and are then conveyed longitudinally in the direction indicated by arrow A by conveyor belts 5, 5*a*, which are driven by motor 8, and by virtue of the downward pressure applied by the weight of pressure-applying rollers 9, until the leading edge 51 of the leading sack 52 has reached the photocell 46 (see FIG. 2) so that the light beam impinging on photocell 46 has been interrupted, thereby providing a signal to de-energize drive motor 8 and stop movement of the conveyor belts and sacks. When this has been effected, the retaining rods 16 are caused to descend (by suitable means, not shown) to force the next succeeding sack 52*a* against the now arrested conveyor belts 5. Thereafter, the backing rollers 40, 41, which were initially in the raised position, in which they were spaced upwardly from table top 4, are caused to descend onto the conveyor rollers 42, 43 by operation of the piston-cylinder units 36, 37, to pivot shaft 33 counterclockwise as viewed in FIG. 3 and thereby pivot levers 34 and 35 in the same counterclockwise direction to carry rollers 42, 43 downwardly against sack 52 so that the sack is securely held between the backing rollers 40, 41 and conveyor rollers 42, 43. The motors 44 and 45 are then energized to rotate conveyor rollers 42 and 43 to advance the leading sack 52 in the direction of conveyance until its leading edge 51 interrupts one or both of the light beams that impinge on photocells 47 and 48. If the light beam to photocell 47 has been interrupted first, a signal is provided to de-energize motor 44 while motor 45 continues to operate until the light beam to photocell 48 has been interrupted, so that the leading edge 51 of the leading sack 52 is aligned exactly at right angles to the longitudinal conveying direction. On the other hand, if the light beam to photocell 48 has been interrupted first, a signal is provided to de-energize motor 45 while motor 44 continues to operate until the light beam to photocell 47 has also been interrupted so that the leading edge 51 of the leading sack 52 is aligned at right angles to the longitudinal conveying direction. If the light beams to photocells 47 and 48 are simultaneously interrupted, the leading edge 51 is in proper alignment and both motors 44 and 45 are simultaneously de-energized.

After the longitudinal alignment of the leading edge 51 of sack 52 as described above, the sack then undergoes lateral alignment relative to the conveying direction. In that regard, photocells 49 and 50 are used to sense the positions of the outermost edges of sack 52 to effect the lateral alignment. If the light beam to only one of the photocells 49 and 50 is interrupted when the leading edge of sack 52 is in the proper longitudinal alignment position, it means that the sack 52 lying on the table top 4 is laterally offset relative to the longitudinal center line of table top 4. The lateral offset is eliminated by energizing carriage drive motor 26 in response to a signal indicative of which photocell is not receiving its associated light beam, in order to move the carriage 17 transversely along rails 21, 21*a* toward the photocell 49 or 50 which is sensing its associated light beam. When both photocells 49 and 50 do not sense a light beam, drive motor 26 is de-energized to stop transverse movement of carriage 17 and the sack 52 then has its outer edges in the proper transverse position.

When the sack 52 has thus been properly aligned both longitudinally and laterally it can be gripped by suction cups, mechanical grippers, or the like (not shown), and can be suspended at its open leading end for subsequent operations, e.g., for filling from a filling pipe. Thereafter the carriage 17 returns to its initial position, which is defined by limit switches 27 and 28 and the associated switching plates 29 and 30. Retaining rods 16 are then raised, and the conveying and aligning operations are repeated for the next sack in the series.

In most cases the roll of sacks includes interposed narrow, transversely spaced retaining tapes to retain the sacks in shingled or overlapped relationship on the roll. The retaining tapes must be wound up when the sacks have been deposited on table top 4, and for this purpose the channel member 23 can be provided with a suitable supporting structure to support a shaft that carries rotatably mounted guide rollers 53 and 54 (see FIG. 2) positioned upstream of conveyor rollers 42 and 43 and below table top 4 (see FIG. 1). The two retaining tapes which have been withdrawn are trained around guide rollers 53, 54 and around further tape-guiding rollers 55 (see FIG. 2), and are then wound up on tape-up reels 56 and 57, which are rotatably carried outwardly of side frames 1 and 2 and are driven by motors 58 and 59, respectively.

Although particular embodiments of the present invention have been illustrated and described, it will be apparent to those skilled in the art that various changes and modifications can be made without departing from the spirit of the present invention. It is therefore intended to cover in the appended claims all such changes and modifications that fall within the scope of the present invention.

What is claimed is:

1. Apparatus for aligning a sack which is disposed at the leading end of a series of shingled sacks which have openings at their leading ends, whereby said sack is aligned in a predetermined orientation for subsequent transfer of the sack to a filling apparatus, said alignment apparatus comprising:

(a) a frame;

(b) intermittently driven conveying means supported by the frame for conveying sacks in a longitudinal conveying direction;

(c) at least one pressure-applying roller disposed above the conveying means and acting on the sacks as they are conveyed along the apparatus;

(d) a pair of laterally spaced, rotatable conveyor rollers positioned downstream of the pressure-applying rollers and having their axes of rotation extending transversely relative to the longitudinal conveying direction;

(e) pressure applying means positioned opposite each of said conveyor rollers to urge a sack positioned between said conveyor rollers and said pressure applying means into conveying engagement with said conveyor rollers;

(f) first drive means for independently driving each of said conveyor rollers; and (g) first sensing means for sensing a leading edge of a sack for providing signals to cause said first drive means to orient said leading edge at a desired orientation relative to the longitudinal conveying direction, wherein the conveyor rollers, the pressure applying means, and the first drive means are carried on a carriage which is mounted for transverse movement relative to the conveying direction, and said apparatus includes second drive means for moving said carriage transversely.

2. Apparatus according to claim 1 wherein the conveyor rollers are rotatably mounted on separate parallel axles and are symmetrically disposed on opposite sides of a center line extending longitudinally of the apparatus.

3. Apparatus according to claim 2 wherein said first sensing means includes photoelectric detectors carried on opposite sides of the center line and on a transverse line which defines the desired orientation of the leading edge of each sack, said detectors operative to detect when the sack has properly been aligned for a filling operation, each detector providing a signal upon interruption of a light beam by said sack leading edge, said signal operative to stop the conveyor roller disposed on the same side of the center line in response to the detection of the leading edge of the sack.

4. Apparatus according to claim 1 wherein the pressure applying means are carried at respective ends of levers that are pivotally supported on said carriage and are pivotally movable by fluid-operated piston-cylinder means.

5. Apparatus according to claim 1 including second sensing means for sensing side edges of a sack and for providing signals to operate said second drive means to orient said side edges at a desired lateral orientation relative to the longitudinal conveying direction.

6. Apparatus according to claim 5 wherein said second sensing means includes photoelectric detectors carried on opposite sides of the center line and spaced from each other a distance corresponding to the width of a sack to define a desired orientation of said side edges of said sack relative to the center line, wherein when one of said detectors does not detect the side edge of a sack, a signal is provided to energize the second drive means to move the carriage transversely in the appropriate direction until both of said second sensing means detect the sack, and to then de-energize the second drive means.

7. Apparatus according to claim 6, wherein the transverse spacing of the photoelectric detectors of the second sensing means equals the largest width tolerance for the sacks, and wherein the second drive means remains energized until light beams directed to both photocells are interrupted by the sack edge portions.

8. Apparatus according to claim 1 wherein said apparatus includes a detector positioned upstream of said first sensing means, said detector operative for detecting the leading edge of the filling end of a sack, and for providing a signal to stop said intermittently driven conveying means.

9. Apparatus for aligning a sack which is disposed at the leading end of a series of shingled sacks which have openings at their leading ends, whereby said sack is aligned in a predetermined orientation for subsequent transfer of the sack to a filling apparatus, said alignment apparatus comprising:

(a) a frame:

(b) intermittently driven conveying means supported by the frame for conveying sacks in a longitudinal conveying direction;

(c) at least one pressure-applying roller disposed above the conveying means and acting on the sacks as they re conveyed along the apparatus;

(d) a pair of laterally spaced, rotatable conveyor rollers positioned downstream of the pressure-applying rollers and having their axes of rotation extending transversely relative to the longitudinal conveying direction;

(e) pressure applying means positioned opposite each of said conveyor rollers to urge a sack positioned between said conveyor rollers and said pressure applying means into conveying engagement with said conveyor rollers;

(f) first drive means for independently driving each of said conveyor rollers; and (g) first sensing means for sensing a leading edge of a sack for providing signals to cause said first drive means to orient said leading edge at a desired orientation relative to the longitudinal conveying direction, wherein the conveyor rollers, the pressure applying means, and the first drive means are carried on a carriage which is mounted for transverse movement relative to the conveying direction, and said apparatus includes second drive means for moving said carriage transversely, the apparatus further including second sensing means for sensing side edges of a sack and for providing signals to operate said second drive means to orient said side edges at a desired lateral orientation relative to the longitudinal conveying direction wherein said second sensing means includes photoelectric detectors carried on opposite sides of the center line and spaced from each other a distance corresponding to the width of a sack of define a desired orientation of said side edges of said sack relative to the center line, wherein when one of said detectors does not detect the side edge of a sack, a signal is provided to energize the second drive means to move the carriage transversely in the appropriate direction until both of said second sensing means detect the sack, and to then de-energize the second drive means and the apparatus further including limit switches carried on said frame for providing signals to position the carriage in our initial position.

10. Apparatus according to claim 9 including retaining means for retaining a succeeding sack in arrested condition relative to a preceding sack, said retaining means operative in response to said signal and provided by said detector.

11. Apparatus according to claim 9 wherein the operation of said pressure applying means and the operation of said first drive means is in response to a signal from the first sending means.

* * * * *